US005189474A

United States Patent [19]

Miya et al.

[11] Patent Number: 5,189,474

[45] Date of Patent: Feb. 23, 1993

[54] AGITATING MEMBER FOR A DEVELOPING APPARATUS

[75] Inventors: Shigeyuki Miya; Takenori Shibata, both of Utsunomiya; Yoshihiro Komatsu, Imaichi; Hiromichi Miyoshi, Utsunomiya; Tadashi Hirata, Kawagoe; Yoshio Taniguchi, Tokyo; Takuo Kobayashi, Utsunomiya, all of Japan

[73] Assignee: Matsushita Electric Industrial Co., Ltd., Osaka, Japan

[21] Appl. No.: 686,973

[22] Filed: Apr. 18, 1991

[30] Foreign Application Priority Data

Apr. 18, 1990 [JP] Japan ..... 2-101946
Apr. 18, 1990 [JP] Japan ..... 2-101947
Apr. 18, 1990 [JP] Japan ..... 2-101954

[51] Int. Cl.[5] ..... G03G 15/06; B01F 15/02

[52] U.S. Cl. ..... 355/245; 355/246; 366/157; 366/158

[58] Field of Search ..... 355/245, 246, 253, 251, 355/259; 118/656, 657; 366/154, 155, 156, 157, 158, 169, 170, 224, 308, 310, 325

[56] References Cited

U.S. PATENT DOCUMENTS 4,025,179 5/1977 Hudson ..... 355/253
4,033,294 7/1977 Charland et al. ..... 118/658
4,261,290 4/1981 Yamashita et al. ..... 355/253 X
4,361,109 11/1982 Mayer et al. ..... 355/245 X
4,491,409 1/1985 Pettitt ..... 355/245
4,583,843 4/1986 Ohata et al. ..... 355/253
4,723,143 2/1988 Enomoto ..... 355/253
4,825,244 4/1989 Hediger ..... 355/3 DD
4,855,783 8/1989 Takashima et al. ..... 355/245 X
4,906,104 3/1990 Nishise et al. ..... 366/156 X
4,928,144 5/1990 Kasahara et al. ..... 355/245
4,956,679 9/1990 Takano et al. ..... 355/245 X
4,980,724 12/1990 Tanaka ..... 355/245
5,005,517 4/1991 Fukui et al. ..... 355/246 X

FOREIGN PATENT DOCUMENTS 57-141665 9/1982 Japan .
58-149079 9/1983 Japan .
59-97166 6/1984 Japan .
59-231561 12/1984 Japan .
62-73284 4/1987 Japan .
62-33583 7/1987 Japan .

*Primary Examiner*—A. T. Grimley
*Assistant Examiner*—Nestor R. Ramirez
*Attorney, Agent, or Firm*—Lowe, Price, LeBlanc & Becker

[57] ABSTRACT

A developing apparatus of the type including a developing roller disposed in a development box, a stirring roller parallel spaced apart from the developing roller, and a toner replenisher pipe disposed in the stirring roller, wherein the stirring roller has a substantially hollow cylindrical shape and includes a plurality of axial ribs extending parallel to a longitudinal axis of the stirring roller and disposed equidistantly from the longitudinal axis, and a plurality of helical blades integral with the axial ribs and skewed relative to the longitudinal axis of the stirring roller, said hollow cylindrical stirring roller being composed of at least two identical segments which are divided by a plane extending through said longitudinal axis of said stirring roller. The stirring roller is simple in construction and can be manufactured at a low cost. The developing apparatus further includes a separator for receiving an excess developer which is removed from the outside surface of the developing roller and direct it unto the stirring roller.

9 Claims, 5 Drawing Sheets

AGITATING MEMBER FOR A DEVELOPING APPARATUS

BACKGROUND OF THE INVENTION

1. Field of the Invention

The present invention relates generally to developing apparatus for use in electrophotographic recording machines, and more particularly to a developing apparatus using a developer of the two-component system.

2. Description of the Prior Art

One example of the developing apparatus of the type concerned is disclosed in Japanese Patent Publication No. 62-33583. The disclosed developing apparatus includes a bucket roller rotatably disposed in a development tank or housing and having a plurality of elongate buckets extending between respective peripheral surfaces of a pair of parallel spaced circular disks, a cylindrical tube disposed in the bucket roller and extending along an axis of rotation of the bucket roller, a developer inlet and a developer outlet formed at opposite ends of the cylindrical tube, developer guide members attached to the bucket roller for transporting a developer within the development housing from the developer outlet toward the developer inlet, and a conveyor means disposed in the cylindrical tube for transporting the developer from the developer inlet toward the developer outlet. The bucket roller and the transport means serve to transport the developer in the axial direction of the bucket roller while circulating the developer through the inside and the outside of the cylindrical tube, thereby mixing the developer within the bucket roller. The bucket roller supplies the developer onto a developing roller.

Another developing apparatus is disclosed in U.S. Pat. No. 4,033,294, which comprises a plurality of parallel juxtaposed developing rollers and a mixing and transporting roller disposed adjacent to an endmost one of the developing rollers. The mixing and transporting roller includes a plurality of spaced-apart auger elements mounted on a drive shaft and a plurality of radially extending flat bars mounted on the periphery of the auger elements. The mixing and transporting roller serves to mix a developer while feeding the same in the axial direction and to transport the developer toward the endmost developing roller.

In these known developing apparatus described above, since both the mixing of the developer and the feeding of the developer toward the developing roller are performed at one position or by a single component (by the bucket roller in Japanese Patent Publication No. 62-33583 and by the mixing and transporting roller in U.S. Pat. No. 4,033,294), a sufficient mixing of the developer is not always guaranteed.

Furthermore, in the production of the bucket roller which is used for agitating or stirring the developer, the pair of circular disks and the plural buckets are manufactured separately. After the circular disks and the buckets are assembled together, the plural developer guide members in the form of fins are attached to each bucket by means of screws, for example. In addition, the bucket roller is rotatably mounted on the cylindrical tube via a bush of a sintered metal slidably fitted over a fixed bearing mounted on the cylindrical tube. Thus, the conventional developing apparatus is composed of a relatively large number of structural components, complicated in construction, requires a tedious and time-consuming assembling work and is expensive to manufacture. Another drawback associated with the conventional developing apparatus is an unreliable detection of the density of the developer caused due to an abrasive wear on sliding surfaces of movable components or an improper positioning of a developer density sensor.

SUMMARY OF THE INVENTION

With the foregoing drawbacks of the prior art in view, it is an object of the present invention to provide a developing apparatus having a developer stirring roller disposed around a toner replenisher pipe for mixing and stirring a developer, which developer stirring roller is simple in construction and can be manufactured less costly.

Another object of the present invention is to provide a developing apparatus including a stirring device which is capable of stirring a developer without causing an abrasive wear on sliding surfaces of movable parts which are disposed in the developer.

A further object of the present invention is to provide a developing apparatus which is capable of detecting the density of a developer with accuracy.

A still further object of the present invention is to provide a developing apparatus which is capable of maintaining the amount of developer uniformly distributed over the entire width of a development box.

According to a first aspect of this invention, there is provided a developing apparatus which comprises: a development box; a developing roller disposed in the development box; a stirring roller parallel spaced apart from the developing roller; a toner replenisher pipe disposed in the stirring roller; and the stirring roller having a substantially hollow cylindrical shape including a plurality of axial ribs extending parallel to a longitudinal axis of the hollow cylindrical stirring roller and disposed equidistantly from the longitudinal axis of the stirring roller, and a plurality of helical blades integral with the axial ribs and skewed relative to the longitudinal axis of the stirring roller, the hollow cylindrical stirring roller being composed of at least two identical segments which are divided by a plane extending through the longitudinal axis of the stirring roller.

Preferably, the toner replenisher pipe is an aluminum pipe and the stirring roller is rotatably mounted on the aluminum toner replenisher pipe via a bearing made from aluminum. The toner replenisher pipe has a contact surface held in sliding contact with the contact surface of the bering. Each of the contact surfaces has a rigid anodized aluminum oxide layer.

According to a second aspect of this invention, there is provided a developing apparatus which comprises: a developing roller disposed in the development box; a first stirring roller parallel spaced apart from the developing roller; a toner replenisher pipe disposed in the stirring roller; a second stirring roller disposed between the development roller and the first stirring roller in parallel spaced relation to the development roller and the first stirring roller; the development box having a bottom surface extending arcuately along the periphery of the first and second stirring rollers between the first and second stirring rollers uniformly spaced from the first and second stirring rollers; and a density sensor disposed on the bottom surface at a portion confronting the first stirring roller.

The developing apparatus may include a doctor blade for regulating the amount of a developer on the developing roller, and an elongate separator for receiving an excess developer which is removed from the outside surface of the developing roller by the doctor blade and guiding the excess developer onto the second stirring roller, the separator having, on its upper surface, a plurality of first guide plates extending obliquely in a first direction relative to an axis of the developing roller for guiding the excess developer toward one side of a development box, and a plurality of second guide plates extending obliquely in a second direction relative to the axis of the developing roller for guiding the excess development toward the opposite side of the development box, the first guide plates being disposed on a first longitudinal part of the elongate separator, the second guide plates being disposed on a second longitudinal part of the elongate separator, the first longitudinal part being longer than the second longitudinal part.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1A:
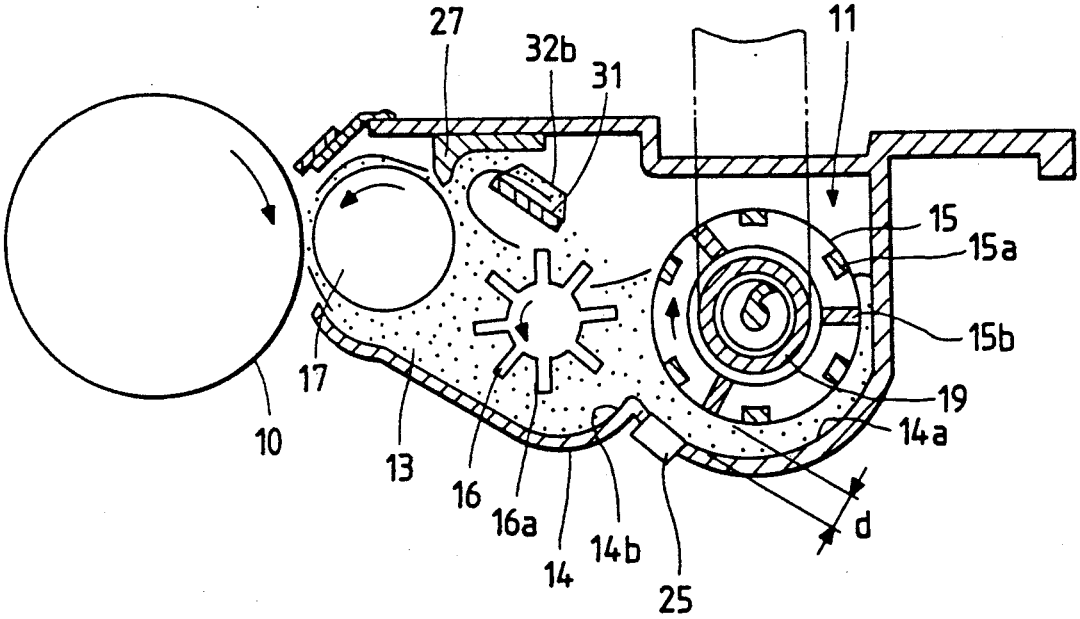
FIGS. 1(*a*) and 1(*b*) are diagrammatical cross-sectional views showing a developing apparatus according to an embodiment of this invention together with peripheral components.
Figure 1B:
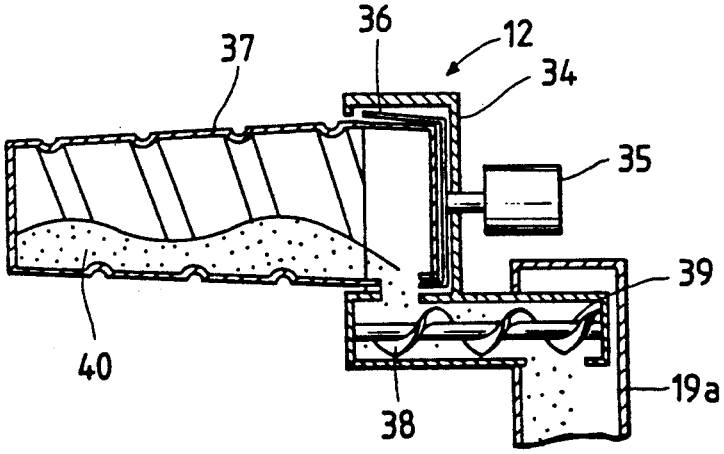

Referring now to the drawings, wherein the like reference characters designate like or corresponding parts throughout the several views, there is shown in FIGS. 1(*a*) and 1(*b*) a part of an electrophotographic copying machine including a photoconductive drum 10, a developing unit or apparatus 11 of this invention for developing an electrostatic latent image formed on the photoconductive drum 10, and a toner replenisher 12 for replenishing a toner into the developing apparatus 11.

Figure 2:
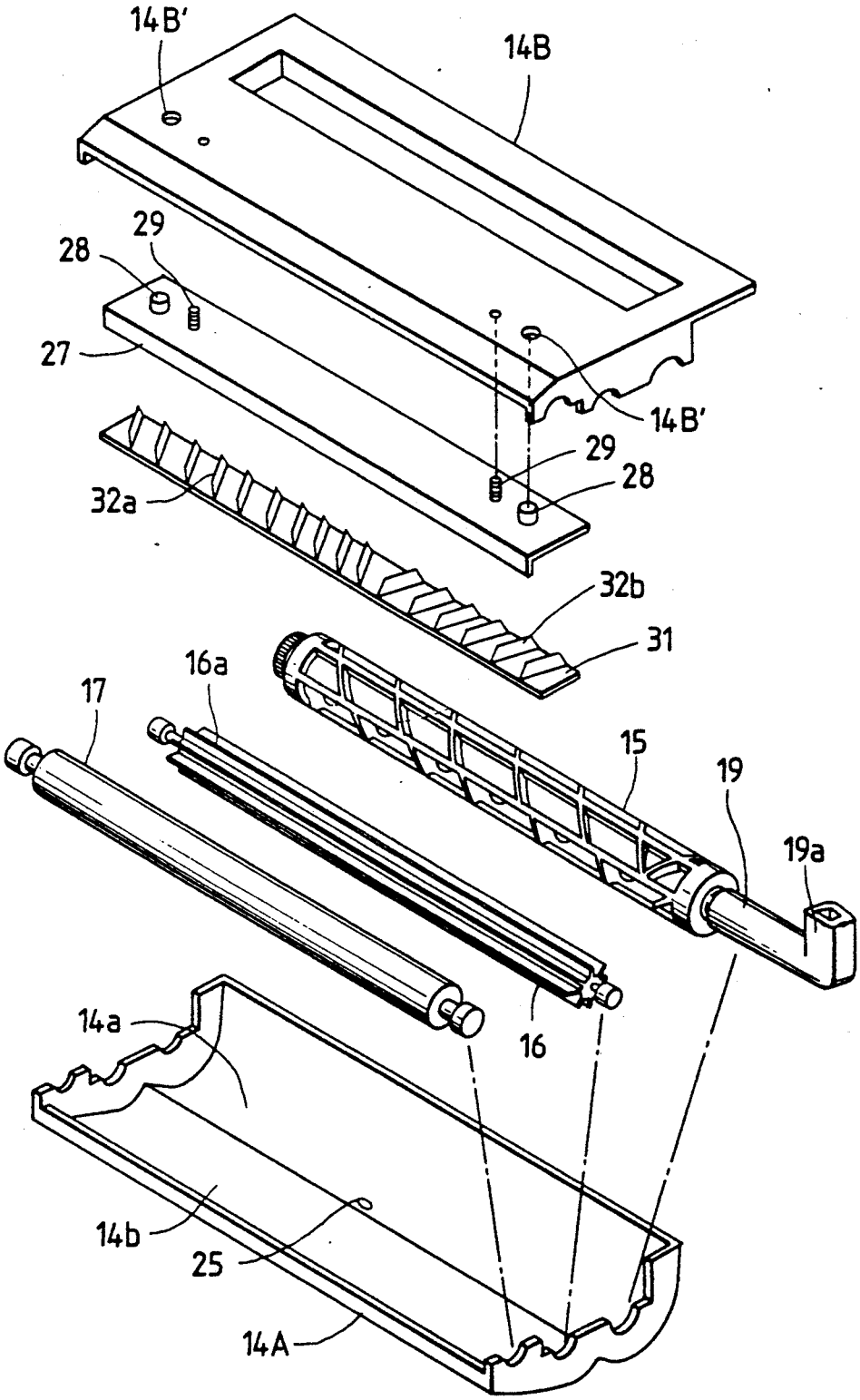
FIG. 2 is an exploded perspective view of the developing apparatus.

The developing apparatus 11 comprises a development box 14 for containing a developer composed of a toner and a carrier, a first stirring roller 15, a second stirring roller 16 and a developing roller 17 which are rotatably disposed in the development box 14. As shown in FIG. 2, the development box 14 is composed of an upper development box member 14A and a lower development box member 14B. The first stirring roller 15 receives therein a toner replenisher pipe 19. The toner replenisher pipe 19 projects outwardly from an end of the development box 14 and is connected at its front end with an upstanding replenisher pipe 19*a* to which the toner replenisher 12 is connected for replenishing the toner into the development box 14.

Figure 4:
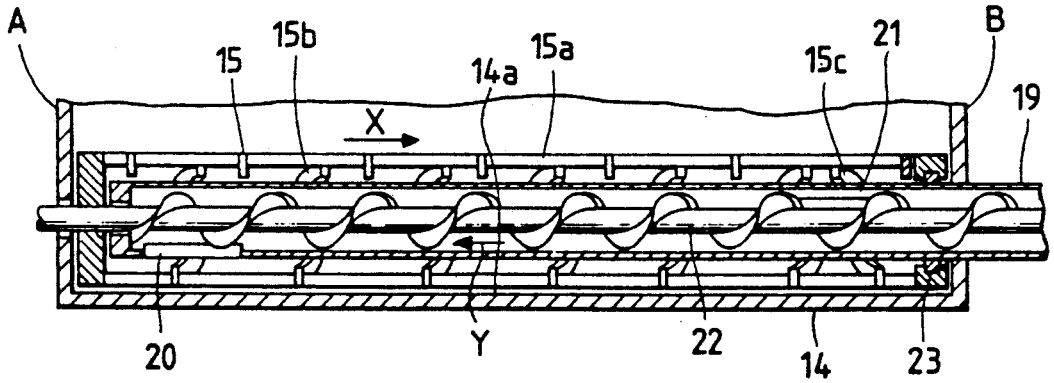
FIG. 4 is a cross-sectional view taken along line IV—IV of FIG. 3.

As shown in FIG. 4, the toner replenisher pipe 19 has an inner end located close to one side A (hereinafter referred to as "first side") of the development box 14 and having a downwardly opening discharge hole 20. The toner replenisher pipe 19 further has an upwardly opening receiving hole 21 disposed near the opposite side B (hereinafter referred to as "second side") of the development box 14. Disposed within the toner replenisher pipe 19 is a helical screw 22 by means of which the toner replenished from the upstanding replenisher pipe 19*a* is fed toward the discharge charge hole 20 and, at the same time, the developer received from the receiving hole 21 is conveyed toward the discharge hole 20.

Figure 3:
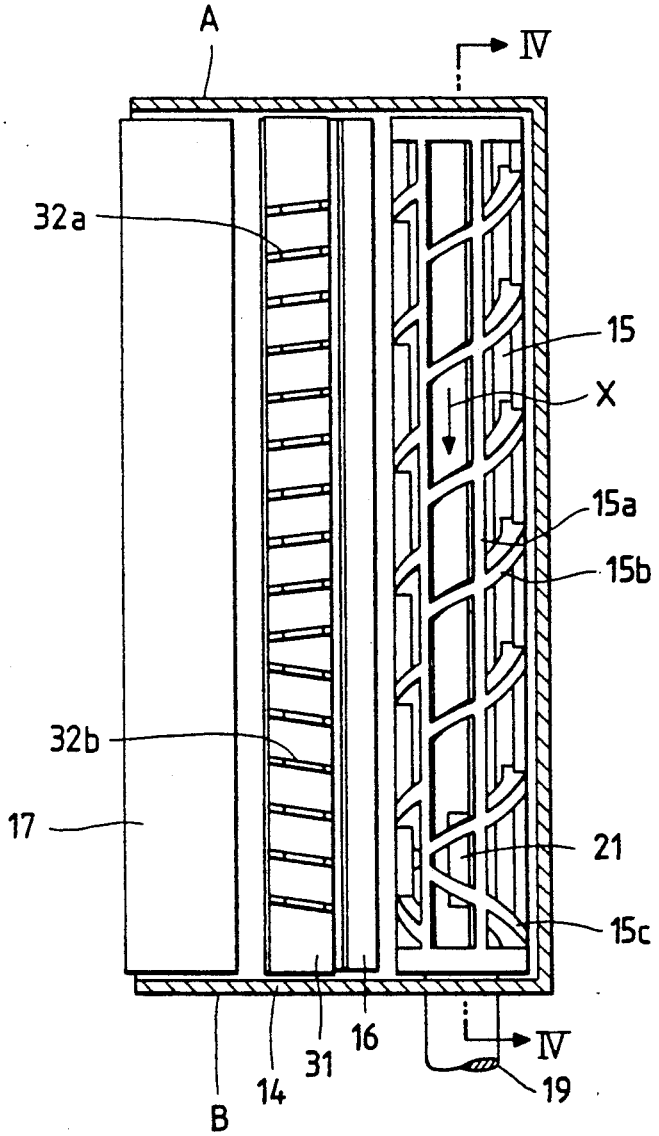
FIG. 3 is a plan view of the developing apparatus with parts cutaway for showing the internal structure of the developing apparatus.

The first stirring roller 15 is a generally hollow cylinder disposed around the toner replenisher pipe 19 and rotatably mounted on the toner replenisher pipe 19 via a baring 23. As shown in FIG. 3, the first stirring roller 15 is provided with a plurality of axial ribs 15*a* extending longitudinally along an axis thereof, a plurality of first helical blades 15*b* extending between the axial ribs 15*a* and skewed in one direction relative to the axis of the first stirring roller 15, and at least one second helical blade 15*c* extending between the axial ribs 15*a* and skewed in the opposite direction relative to the axis of the first stirring roller 15. The second helical blade 15*c* is disposed at only one end of the first stirring roller 15 which is adjacent to the receiving hole 21 in the toner replenisher pipe 19. With this arrangement, when the first stirring roller 15 is rotating in a predetermined direction, the developer existing around the outside surface of the toner replenisher pipe 19 is transported by the first helical blades 15*b* in the direction indicated by the arrow X (FIGS. 3 and 4) from the first side A toward the second side B where the receiving hole 21 is located. The developer which has been conveyed toward the second side B past the receiving hole 21 is returned to the receiving hole 21 by the second helical blade 15*c*. The direction of skew of the first helical blades 15*b* is opposite to the direction of skew of a thread of the spiral screw 22 disposed within the toner replenisher pipe 19 so that by rotating the first stirring roller 15 and the spiral screw 22 in the same direction as a single unit, the developer can be conveyed in the opposite directions as indicated by the arrows X and Y in FIG. 4.

Figure 5:
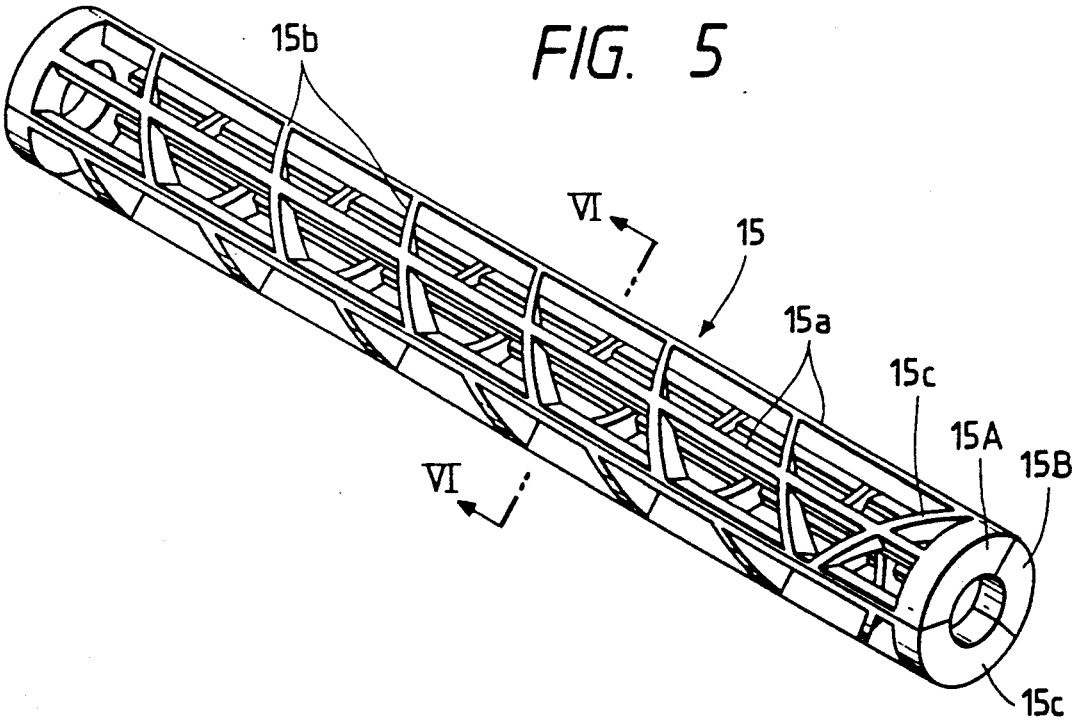
FIG. 5 is a diagrammatical perspective view of a developer stirring roller of the developing apparatus.
Figure 6:
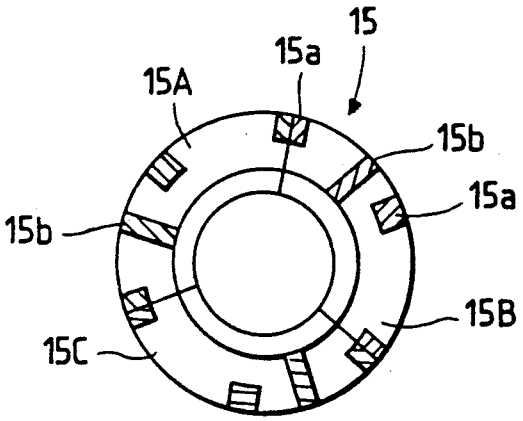
FIG. 6 is an enlarged cross-sectional view taken along line VI—VI of FIG. 5.

As shown in FIG. 4, the first stirring roller 15 has one end rotatably supported by the toner replenisher pipe 19 via the bearing 23, the opposite end of the first stirring roller 15 being fixedly mounted on a shaft of the spiral screw 22. The first stirring roller 15 has a generally hollow cylindrical shape as described above and, as shown in FIGS. 5 and 6, the axial ribs 15*a* are equidistant from the axis of the first stirring roller 15 and circumferentially spaced at equal angular intervals. The first helical blades 15*b* which are skewed in one direction relative to the axis of the first stirring roller 15 are integral with the axial ribs 15*a* and disposed over the entire length of the first stirring roller 15 except for one end where the second helical blade 15*c* is disposed. The number of second helical blade 15*c* is considerably smaller than the number of first helical blades 15*b*. Since the first helical blades 15*b* are skewed in the opposite direction to the thread of the spiral screw 22, rotation of the first stirring roller 15 in the same direction as the rotating spiral screw 22 causes the first helical blades 15*b* to transport the developer longitudinally along the outside surface of the toner replenisher pipe 19 in the direction indicated by the arrow X (which is opposite to the direction Y of conveyance of the toner by the spiral screw 22). The position of the second helical blade 15*c* which is provided to feed the developer back to the receiving hole 21 is changed depending on the position of the receiving hole 21.

Figure 7:
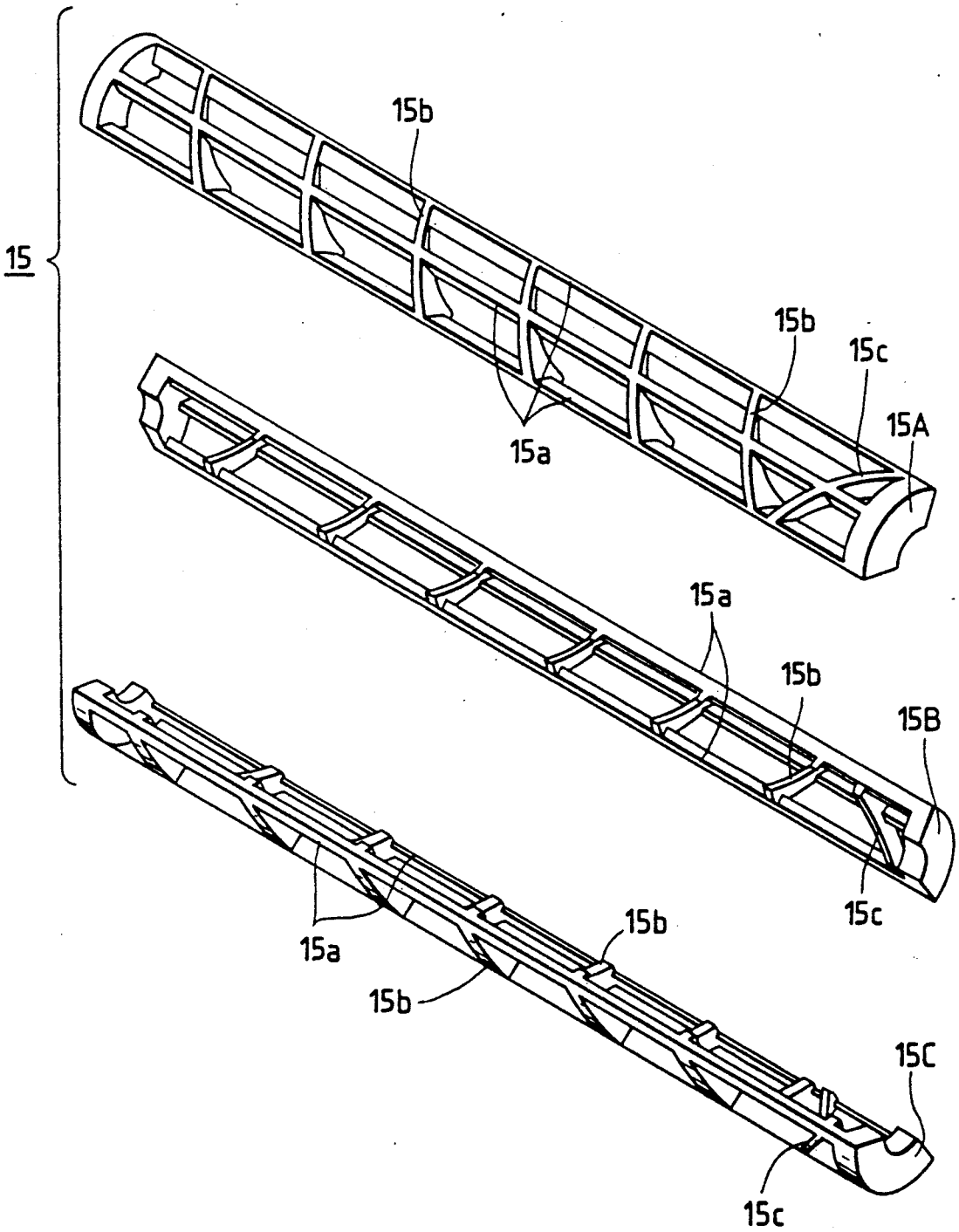
FIG. 7 is an exploded perspective view of the developer stirring roller.

The first stirring roller 15 of the substantially hollow cylindrical shape is divided into three equal parts or segments 15A, 15B and 15C which are divided by three radial planes extending through corresponding ones of the axial ribs 15*a* and converging into the longitudinal axis of the first stirring roller 15, as shown in FIG. 7. These segments 15A–15C are identical in construction and injection-molded of a synthetic resin. Since the segments 15A–15C have a substantially sectoral cross section, they can readily be molded in and then removed from a mold which is composed of a mating pair of mold members separable respectively in radial inward and outward directions of the cross-sectionally sectoral segments 15A–15C. Such mold is simple in construction and inexpensive to manufacture with the result that the segments 15A–15C can be molded at a low cost. The segments 15A–15C thus molded are bonded together with their axial ribs 15*a* held in abutment with each other, thus forming a first stirring roller 15. In this instance, since each segment 15A–15C has axial rib halves extending along opposite longitudinal edges thereof, and since the axial rib halves have a relatively large bonding area, bonding process can be performed stably and reliably. In the illustrated embodiment, the helical blades 15*b* on one segment 15A, 15B or 15C are disposed in staggered relation to the helical blades 15*b* on the adjacent segment 15B, 15C, 15A. The helical blades 15*b* on one segment 15A, 15B or 15C may be connected end to end with the helical blades 15*b* on the adjacent segment 15B, 15C, 15A so as to jointly form a single continuous helical blade. At the time of bonding the three identical segments 15A–15C, the bearing 23 (FIG. 4) is properly gripped by and between the segments 15A–15C in such a manner that it is secured to an end of the first stirring roller 15 composed of the bonded three identical segments 15A–15C. In the illustrated embodiment, the first stirring roller 15 is composed of three identical segments 15A–15C. The first stirring roller 15 may be composed of two or more than four segments.

The bearing 23 for rotatably mounting the first stirring roller 15 on the toner replenisher pipe 19 is made of aluminum and comprises a plain bearing which works by sliding action on the toner replenisher pipe 19. The bearing 23 has a rigid anodized aluminum oxide layer on its inner peripheral surface which is held in sliding contact with the outside surface of the toner replenisher pipe 19. At least a portion of the outside surface of the toner replenisher pipe 19 which is held in sliding contact with the bearing 23 also has a rigid anodized aluminum oxide layer. With the rigid anodized aluminum oxide layers thus provided, respective contacting surfaces of the toner replenisher pipe 19 and the bearing 23 are rigid and highly resistant to abrasive wear, so that the developing apparatus 11 is operable reliably over a prolonged period of use even when the carrier in the developer can get into a clearance between the toner replenisher pipe 19 and the bearing 23.

It was proved by experiments that preferable contact surfaces composed of such rigid anodized aluminum oxide layers had a Vickers hardness greater than 340 and a thickness not less than 30 μ. By using a developing apparatus of the foregoing construction, a test for abrasive wear on the sliding surfaces was made. A toner replenisher pipe 19 of the developing apparatus was made of aluminum and had an outside diameter of 22 mm, while a bearing 23 was made of aluminum and had an inside diameter of 22.3 mm, an outside diameter of 28 mm and a width of 6 mm. The toner replenisher pipe 19 had a contact surface composed of a rigid anodized aluminum oxide layer of 30 μ in thickness and having a Vickers hardness of 340. Similarly, the bearing 23 had a contact surface composed of a rigid anodized aluminum oxide layer having a thickness of 30 μ and a Vickers hardness of 340. After a 400 hours running test of the developing apparatus, the contact surfaces of the toner replenisher pipe 17 and the bearing 23 were visually inspected for abrasive wear with the result no particular change was recognized on the contact surfaces.

A comparative test was made by using a developing apparatus of the type having an aluminum toner replenishing having a contact surface free of anodized aluminum oxide surface layer, and a stirring roller molded of poplyacetal resin directly journaled on the pipe without a bearing. A visual inspection performed after a 400 running test of the developing apparatus found that the outer surface of the pipe and the inner surface of the stirring roller had grooves of about 1 mm depth formed by abrasive wear.

As shown in FIGS. 1(*a*) and 2, the second stirring roller 16 has a plurality of radial flat bars 16*a* (eight in the illustrated embodiment). The development box 14 has a bottom surface extending between the first and second stirring rollers 15 and 16 arcuately along the periphery of the respective rollers 15, 16 and spaced uniformly from the rollers 15, 16. More specifically, the bottom surface is composed of a first arcuate bottom surface portion 14*a* extending along a part of the full circumference of the first stirring roller 15 and spaced from the first stirring roller 15 by a gap d (FIG. 1(*a*)), and a second arcuate bottom surface portion 14*b* extending along a part of the full circumference of the second stirring roller 16 and spaced from the second stirring roller 16 by the same gap. With the bottom surface portions 14*a*, 14*b* thus constructed, when the first and second stirring rollers 15 and 16 are rotating in opposite directions indicated by the arrows in FIG. 1(*a*), the developer is squeezed from the opposite directions along the first and second bottom surface portions 14*a*, 14*b* so as to gather into a space between the first and second stirring rollers 15, 16 and then is mixed sufficiently and uniformly in this space by agitation by the rollers 15, 16. During that time, the developer is conveyed and then mixed continuously without staying or stopping between the first and second stirring rollers 15 and 16. The arcuate bottom surface portions 14*a*, 14*b* may be composed of a number of flat surfaces joined together to form a substantially arcuate shape.

A developer density sensor 25 is disposed at the bottom surface portion 14*a* in confrontation to the first stirring roller 15. Though not restrictive, the developer density sensor 25 is of the inductance type known per se which is constructed to detect a toner-to-carrier mixing ratio depending on the inductance of the developer. Since the bottom surface portion 14*a* at which the density sensor 25 is disposed is formed arcuately to enable the developer to move continuously and smoothly therealong, the density of the developer can always be detected accurately at the real time by the developer density sensor 25.

If the developer were caused to stay on the developer density sensor 25, the developer density sensor 25 would always detect the density of the staying part of the developer, thus failing to perform an accurate density measurement of the developer. Such problem never arises in the developing apparatus of this invention because the developer on the developer density sensor 25 is always renewed. Thus, the density of the developer in the development box 14 can be detected accurately by the density sensor 25 on the real time basis. For a reliable detection of the developer density, the gap d between the first stirring roller 15 and the density sensor 25 is preferably in the range of from 0.2 to 2.0 mm.

As shown in FIG. 1(*a*), the developing apparatus 11 further includes an elongate doctor blade 27 for controlling the thickness of the developer carried on the developing roller 17. The doctor blade 27, as shown in FIG. 2, includes a pair of positioning pins 28, 28 disposed adjacent to opposite ends thereof. The positioning pins 28 are fitted in corresponding positioning holes 14B' in the upper development box member 14B and then a pair of set screws 29 is threaded through the doctor blade 27 into the upper development box member 14B, so that the doctor blade 27 can be attached to a predetermined position on the upper development box member 14B. The doctor blade 27 is disposed close to the developing roller 17 with a predetermined gap therebetween when the upper development box member 14B is secured to the lower development box member 14A. The doctor blade 27 is adjustable in position relative to the developing roller 17.

Referring back to FIG. 1(*a*), an elongate separator 31 in the form of a flat bar 31 is disposed adjacent to the doctor blade 27 and sloping down toward the first stirring roller 15 for receiving excess developer scraped off from the developing roller 17 and returning the same to the development box 14. The separator 31 has on its upper surface a group of first guide plates 32*a* and a group of second guide plates 32*b* that are provided for restricting the direction of movement of the excess developer as the developer is returned to the development box 14. As shown in FIG. 3, the first and second guide plates 32*a*, 32*b* extend divergently from the developing roller 17 toward the first stirring roller 15. The first guide plates 32*a*, which are disposed on a first longitudinal part of the separator 31 located on the first side A of the development box 14, extend obliquely relative to a longitudinal axis of the separator 31 (i.e., a longitudinal axis of the developing roller 17) so that the developer is guided by the first guide plates 32*a* toward the first side A of the development box 14. On the other hand, the second guide plates 32*b*, which are disposed on a second longitudinal portion of the separator 31 located on the second side B of the development box 14, extend obliquely relative to the longitudinal axis of the separator 31 so that the developer is guided by the second guide plates 32*b* toward the second side B of the development box 14.

With the guide plates 32*a*, 32*b* thus provided, the developer returned from the developing roller 17 is distributed unevenly over the width of the development box 14 and is concentrated toward the opposite sides of the development box 14. As shown in FIGS. 2 and 3; the first longitudinal part (let-hand part in FIG. 2) of the separator 31 which carries thereon the first guide plates 32*a* is longer than the second longitudinal part on which the second guide plates 32*a* are disposed. It was proved by experiments that the length of the first longitudinal part and the length of the second longitudinal part were preferably in the ratio ranging from 1.5:1 to 3:1.

When the first stirring roller 15 and the spiral screw 22 in the toner replenisher pipe 19 are rotating, the developer is caused to circulate between the first side A and the second side B of the development box 14. In this instance, the developer tends to gather at the second side B (which is adjacent to the receiving hole 21 in the toner replenisher pipe 19). However, an excess developer which has been removed from the developing roller 17 is returned by the separator 31 into the developing housing 14 in such a manner that the first guide plates 32*a* deliver a greater amount of developer toward the first side A than the amount of developer which is delivered toward the second side B by the second guide plates 32*b*. Such unevenly distributed return of the excess developer compensates for an uneven distribution of the developer caused by the first stirring roller 15 in the manner stated above. The developer is, therefore, distributed uniformly over the entire width of the development box 14.

As shown in FIG. 1(*b*), the toner replenisher 12 includes a case 34, a geared motor 35 mounted on the case 34, a toner tank holder 36 driven by the geared motor 35, a toner tank 37 held by the toner tank holder 36, a toner discharge pipe 38 connected at its one end with an open end of the toner tank 37, and a spiral screw 38 disposed within the toner discharge pipe 38. When the geared motor 35 is driven to rotate the toner tank 37, a toner 40 is supplied from the toner tank 37 into the discharge pipe 38 and thence to the upstanding replenisher pipe 19*a*.

The developing apparatus 12 of the foregoing construction operates as follows.

During a development cycle, the photoconductive drum 10, the developing roller 17, the first stirring roller 15 and the second stirring roller 16 are rotating in the direction indicated by the arrows in FIG. 1(*a*). A fresh toner supplied into the toner replenisher pipe 19 is conveyed by the spiral screw 22 in the direction indicated by the arrow Y in FIG. 4, then discharged from the discharge hole 20 adjacent to the first side A of the development box 14, and finally mixed up with the developer existing around the outside surface of the toner replenisher pipe 19. By the rotation of the first stirring roller 15, the developer is conveyed spirally around the outer surface of the toner replenisher pipe 19 in the direction of the arrow X from the first side A toward the second side B. During that time, the developer is sufficiently stirred up and hence mixed uniformly. Then, upon arrival at the receiving hole 21, the developer is forced into the toner replenisher pipe 19, subsequently fed by the spiral screw 22 in the opposite direction Y toward the discharge hole 20, and finally discharged from the discharge hole 20 to the outside of the toner replenisher pipe 19. The developer is thus circulated through the outside and the inside of the toner replenisher pipe 19 during which time it is mixed and stirred up uniformly.

As shown in FIG. 1(*a*), a part of the uniformly mixed developer is advanced by the first stirring roller 15 along the arcuate bottom surface portion 14*a* toward the second stirring roller 16 which in turn supplies the developer onto the developing roller 17 while stirring the same. The developer attracted on the outer surface of the developing roller 17 is regulated in thickness by the doctor blade 27 and then transferred onto the photoconductive drum 10 to develop an electrostatic latent image formed on the photoconductive drum 10. An excess amount of developer is scraped off from the developing roller 17 by the doctor blade 27 and then returned by the separator 31 to the receiving side of the second stirring roller 16. In this instance, the guide plates 32*a*, 32*b* control the direction of movement of the developer in the manner described above.

The density sensor 25 detects the density of the developer in a region adjacent to the first stirring roller 15. When the detected density of the developer is lower than a predetermined level, the density sensor 25 issues a command signal to energize the toner replenisher 12 for replenishing the tone until the predetermined toner density level is reached. The density sensor 25 is disposed at a position immediately downstream of the first stirring roller 15 and hence is capable of detecting the density of the developer immediately after it is mixed with a fresh toner. The detection of the developer density follows the replenishing of the fresh toner without delay, so that a toner density control can be performed reliably without involving hunting.

Obviously various minor changes and modifications of the present invention are possible in the light of the above teaching. It is therefore to be understood that within the scope of the appended claims the invention may be practiced otherwise than as specifically described.

What is claimed is:

1. A developing apparatus which comprises:

(*a*) a development box;

(*b*) a developing roller disposed in said development box;

) a stirring roller parallel spaced apart from (c said developing roller;

(d) a toner replenisher pipe disposed in said stirring roller; and (e) said stirring roller having a substantially hollow cylindrical shape including a plurality of axial ribs extending parallel to a longitudinal axis of said hollow cylindrical stirring roller and disposed equidistantly from said longitudinal axis of said stirring roller, and a plurality of helical blades integral with said axial ribs and skewed relative to said longitudinal axis of said stirring roller, said hollow cylindrical stirring roller being composed of at least two identical segments which are divided by a plane extending through said longitudinal axis of said stirring roller.

2. A developing apparatus according to claim 1, wherein said stirring roller is composed of three identical segments which are divided by three radial planes converging into said longitudinal axis of said stirring roller.

3. A developing apparatus according to claim 1, wherein said toner replenisher pipe has a discharge hole disposed adjacent to one side of said development box and a receiving hole disposed adjacent to the opposite side of said development box, said helical blades being skewed in a first direction to convey a developer longitudinally along an outside surface of said toner replenisher pipe in a direction from said discharge hole toward said receiving hole, said helical blades being disposed substantially along the entire length of said stirring roller except for an end portion in which said receiving hole is formed.

4. A developing apparatus according to claim 3, wherein said stirring roller further includes at least one second helical blade disposed at said end portion and skewed in a direction opposite to said first direction.

5. A developing apparatus which comprises:

(*a*) a development box;

(*b*) a developing roller disposed in said development box;

(c) a stirring roller parallel spaced apart from said developing roller;

(d) a toner replenisher pipe disposed in said stirring roller, said toner replenisher pipe being an aluminum pipe;

(e) said stirring roller being rotatably mounted on said toner replenisher pipe and including a bearing slidably fitted around said toner replenisher pipe, said bearing being a plain bearing mode made of aluminum; and (f) said toner replenisher pipe having a contact surface, said bearing having a contact surface held in sliding contact with said contact surface of said toner replenisher pipe, each of said contact surfaces having a rigid anodized aluminum oxide layer.

6. A developing apparatus according to claim 5, wherein said rigid anodized aluminum oxide layer has a thickness of not less than 30 $\mu$ and a Vickers hardness greater than 340.

7. A developing apparatus, comprising:

(a) a development box;

(b) a developing roller disposed in said development box;

(c) a first stirring roller disposed parallel to and spaced apart from said developing roller;

(d) a toner replenisher pipe disposed in said first stirring roller;

(e) a second stirring roller disposed between said development roller and said first stirring roller in parallel spaced relation to said development roller and said first stirring roller;

(f) said development box having a bottom surface comprising a first arcuate bottom surface portion and a second arcuate bottom surface portion adjoining each other, said first arcuate bottom surface portion extending along a periphery of said first stirring roller and spaced uniformly from said first stirring roller by a first distance, said second arcuate bottom surface portion extending along a periphery of said second stirring roller and spaced uniformly from said second stirring roller by a second distance equal to said first distance; and (g) a toner density sensor disposed at said first arcuate bottom surface in a confronting relationship to face said first stirring roller and located adjacent to a junction between said first and second arcuate bottom surface portions so that said toner density sensor is spaced by said first distance from said first stirring roller.

8. A developing apparatus which comprises:

(a) a development box;

(b) a developing roller disposed in said development box;

(c) a first stirring roller extending parallel to said developing roller and rotatable in a predetermined direction for stirring a developer while conveying the developer in the axial direction of said first stirring roller from one side toward the opposite side of said development box;

(d) conveyor means disposed in said first stirring roller for conveying the developer from said opposite side toward said one side of said development box;

(e) a second stirring roller disposed between said developing roller and said first stirring roller in parallel spaced relation to said developing roller and said first stirring roller and rotatable for supplying the developer onto said developing roller while stirring the developer;

(f) a doctor blade for regulating the amount of the developer on said developing roller; and (g) an elongate separator for receiving an excess developer which is removed from the outside surface of said developing roller by said doctor blade and guiding the excess developer onto said second stirring roller, said separator having, on its upper surface, a plurality of first guide plates extending obliquely in a first direction relative to an axis of said developing roller for guiding the excess developer toward said one side of said development box, and a plurality of second guide plates extending obliquely in a second direction relative to said axis of said developing roller for guiding the excess development toward said opposite side of said development box, said first guide plates being disposed on a first longitudinal part of said elongate separator, said second guide plates being disposed on a second longitudinal part of said elongate separator, said first longitudinal part being longer than said second longitudinal part.

9. A developing apparatus according to claim 8, wherein the length of said first longitudinal part of said elongate separator and the length of said second longitudinal part of said elongate separator are in the ratio ranging from 1.5:1 to 3:1.

* * * * *